US008651973B2

(12) United States Patent
Okot

(10) Patent No.: US 8,651,973 B2
(45) **Date of Patent: *Feb. 18, 2014**

(54) GOLF CLUB WITH WIND RESISTANT SHAFT AND GOLF CLUB HEAD

(75) Inventor: Alex W. Okot, Amsterdam (NL)

(73) Assignee: Nike, Inc., Beaverton, OR (US)

( * ) Notice: Subject to any disclaimer, the term of this patent is extended or adjusted under 35 U.S.C. 154(b) by 253 days.

This patent is subject to a terminal disclaimer.

(21) Appl. No.: 12/791,111

(22) Filed: Jun. 1, 2010

(65) Prior Publication Data

US 2011/0294590 A1 Dec. 1, 2011

(51) Int. Cl.
*A63B 53/04* (2006.01)
*A63B 53/12* (2006.01)
*A63B 53/10* (2006.01)

(52) U.S. Cl.
USPC ..... 473/317; 473/327

(58) Field of Classification Search
USPC ..... 473/317, 327
See application file for complete search history.

(56) References Cited

U.S. PATENT DOCUMENTS

| | | | | |
|---|---|---|---|---|
| 1,854,548 | A | 4/1932 | Hunt | |
| 1,890,037 | A | 12/1932 | Johnson | |
| 2,169,774 | A * | 8/1939 | Taylor | 473/564 |
| 3,614,101 | A * | 10/1971 | Hunter | 473/301 |
| 3,794,328 | A | 2/1974 | Gordon | |
| 3,834,700 | A * | 9/1974 | Averbach | 473/409 |
| 4,283,057 | A | 8/1981 | Ragan | |
| 5,271,622 | A | 12/1993 | Rogerson | |
| 5,335,908 | A | 8/1994 | Bamber | |
| 5,513,845 | A | 5/1996 | Sonagere | |
| 5,807,187 | A | 9/1998 | Hamm | |
| 5,873,793 | A | 2/1999 | Swinford | |
| 5,904,626 | A * | 5/1999 | Fendel et al. | 473/296 |
| 5,921,870 | A * | 7/1999 | Chiasson | 473/317 |
| 5,994,619 | A | 11/1999 | Stice et al. | |
| 6,027,414 | A | 2/2000 | Koebler | |
| 6,074,308 | A | 6/2000 | Domas | |
| 6,471,602 | B1 | 10/2002 | D'Orazio | |
| 6,561,922 | B2 | 5/2003 | Bamber | |
| 6,609,981 | B2 | 8/2003 | Hirata | |
| 6,824,474 | B1 | 11/2004 | Thill | |

(Continued)

FOREIGN PATENT DOCUMENTS

| | | | |
|---|---|---|---|
| GB | 2318738 | A | 5/1998 |
| GB | 2387121 | A * | 10/2003 |

(Continued)

OTHER PUBLICATIONS

International Search Report and Written Opinion, issued Jan. 11, 2013, in counterpart International Patent Application No. PCT/US2011/036174.

*Primary Examiner* — Stephen L. Blau
(74) *Attorney, Agent, or Firm* — Banner & Witcoff, Ltd.

(57) ABSTRACT

Golf club, golf club shaft and golf club head structures are presented. The golf club may include a shaft having a core and an airfoil shaped skin substantially surrounding the core and in contact with the core. The golf club may further include a golf club head having a plurality of apertures formed in a front face of the golf club head and extending through an interior of the golf club head to a rear portion of the golf club head. The apertures may narrow or widen as they extend from the front face to the rear portion.

30 Claims, 12 Drawing Sheets

(56) References Cited

U.S. PATENT DOCUMENTS

| | | | | |
|---|---|---|---|---|
| 2002/0077194 | A1* | 6/2002 | Carr et al. | 473/317 |
| 2004/0097298 | A1 | 5/2004 | Hsieh | |
| 2004/0116197 | A1* | 6/2004 | Benson | 473/239 |
| 2005/0124435 | A1 | 6/2005 | Gambetta et al. | |
| 2005/0143186 | A1* | 6/2005 | Blattner et al. | 473/296 |
| 2006/0014588 | A1 | 1/2006 | Page | |
| 2007/0093315 | A1 | 4/2007 | Kang | |
| 2009/0124409 | A1 | 5/2009 | Greeves | |
| 2010/0022325 | A1* | 1/2010 | Doran | 473/327 |
| 2011/0009208 | A1* | 1/2011 | Roger et al. | 473/317 |
| 2011/0118050 | A1* | 5/2011 | Brown et al. | 473/317 |

FOREIGN PATENT DOCUMENTS

| | | | |
|---|---|---|---|
| WO | 0174458 | A1 | 10/2001 |
| WO | 0178849 | A1 | 10/2001 |
| WO | 2009065172 | A1 | 5/2009 |

* cited by examiner

GOLF CLUB WITH WIND RESISTANT SHAFT AND GOLF CLUB HEAD

FIELD OF THE INVENTION

The present invention relates generally to golf clubs and golf club heads. Particular example aspects of this invention relate to a golf club having a shaft shaped to reduce wind resistance during a golf swing and a golf club head configured to reduce wind resistance during a golf swing.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

One aspect of the game that impacts performance is a player's swing and, in particular, swing speed. Swing speed is the speed at which a player moves his club through a swing and can often affect the distance a ball is hit. For instance, as a golfer swings the club from the end of the backswing through contact with the ball, the speed of the swing may have an impact on the flight of the ball, distance the ball will travel, etc. Increasing the swing speed may, in some arrangements, increase the distance a golf ball will travel. However, swing speed is impacted by the geometry of the golf club. As air flows over the golf club during the swing, various portions of the golf club, including the shaft and golf club head, create drag through the air which reduces swing speed. Accordingly, it would be advantageous to reduce the drag associated with the shaft and golf club head during a golf swing in order to increase swing speed.

SUMMARY OF THE INVENTION

The following presents a simplified summary in order to provide a basic understanding of some aspects of the invention. The summary is not an extensive overview of the invention. It is neither intended to identify key or critical elements of the invention nor to delineate the scope of the invention.

The following summary merely presents some concepts of the invention in a simplified form as a prelude to the description below Aspects of this invention relate to golf club, golf club shaft, and golf club head structures that may reduce drag associated with a golf club during a golf swing. Aspects of this invention may be used with various types of golf clubs, including wood-type golf clubs, hybrid golf clubs, iron-type golf clubs, and the like. The golf club may include a shaft having a core and an airfoil shaped skin substantially surrounding the core. The airfoil shaped skin may aid in reducing draft associated with the shaft during a golf swing. In some examples, the airfoil shaped skin may include a textured exterior surface to further aid in reducing drag. In some examples, the skin may be removable from the core and interchangeable with skins having different characteristics.

The golf club may also include a golf club head having various drag reducing characteristics. For instance, the golf club head may include a plurality of apertures formed in a front face of the golf club head. In some examples, the apertures may be formed around a portion of a periphery of the front face of the golf club head. In some arrangements, a portion of a ball striking surface of the front face may be void of apertures. The apertures may extend from the front face of the golf club head through an interior of the golf club head to a rear of the golf club head. In some examples, portion of the apertures within the interior of the golf club head may have a constant size, shape, cross section, etc. Additionally or alternatively, one or more apertures may have a non-constant size, shape, cross section, etc. as it extends from the front face to the rear portion of the golf club head.

BRIEF DESCRIPTION OF THE DRAWINGS

The present invention is illustrated by way of example and not limited in the accompanying figures, in which like reference numerals indicate similar elements throughout, and in which.

Figure 1A:
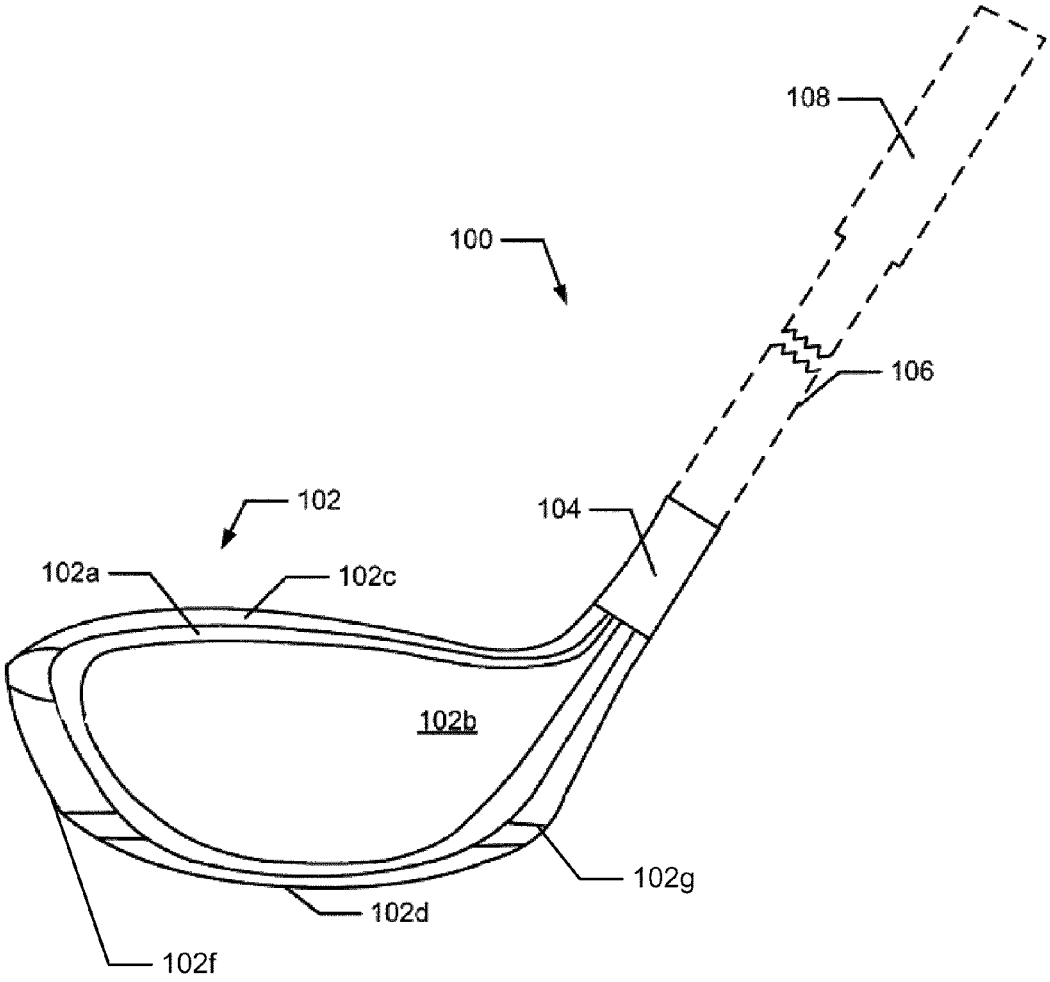
FIGS. 1A and 1B generally illustrate features of golf club and golf club head structures according to at least some examples of this invention.

The reader is advised that the various parts shown in these drawings are not necessarily drawn to scale.

DETAILED DESCRIPTION

The following description and the accompanying figures disclose features of golf clubs, golf club shafts, and golf club head structures in accordance with examples of the present invention.

I. General Description of Example Golf Clubs and Golf Club Shafts in Accordance with this Invention Aspects of this invention relate to golf clubs having a golf club head. The golf club head may be any known type of golf club head. The golf club may further include a shaft having a first end connected to the golf club head. In at least some examples, the shaft may further include a core formed of a first material and an airfoil shaped skin formed of a second material. In at least some arrangements, the airfoil shaped skin may extend around the core and be in contact with the core. In some examples, the airfoil shaped skin may be removable from the core and may include a textured exterior surface. The golf club may further include a grip removably connected to a second end of the shaft and configured to allow removal of the skin from the core. In at least some examples, the grip may include a fastener configured to mate with a corresponding fastener arranged on the core of the shaft. In some examples, the fastener of the grip and the corresponding fastener of the core may be a threaded fastener arrangement.

In some arrangements, the first material of the core and the second material of the skin may be the same or substantially the same material. In other examples, the first material and the second material may be different materials. In at least some arrangements, the grip may be formed of a third material different from the first and second materials. In some examples, the textured exterior surface of the airfoil shaped skin may be formed using at least one of spray on metal texturing, shot peening and sand blasting. In one or more arrangements, the airfoil shaped skin may be in contact with the core but not connected to the core.

Still additional aspects of the invention relate to a golf club having a golf club head and a shaft having a first end connected to the golf club head. The golf club shaft may further include a core and airfoil shaped skin. In at least some examples, the airfoil shaped skin may extend around the core and may be in contact with the core. In some arrangements, the airfoil shaped skin may be removable from the shaft. The golf club may further include a grip removably connected to a second end of the shaft. In at least some examples, the grip may include a fastener configured to mate with a corresponding fastener arranged on the core of the shaft. In some arrangements, the fastener may be a threaded fastener.

Still other aspects of the invention relate to a golf club having a golf club head and a shaft having a first end connected to the golf club head at a hosel. The shaft may further include a core having a substantially circular cross section and a skin arranged substantially around the core and having an airfoil shaped geometry. In at least some examples, the skin may be in contact with the core and may be configured to flex with the core of the shaft. In some arrangements, a widest portion of the skin may be aligned with a diameter of the core. In at least some examples, the skin may include a texture formed on an exterior surface of the skin.

II. General Description of Example Golf Clubs and Golf Club Heads in Accordance with this Invention Aspects of the invention relate to golf clubs having a shaft including a core and an airfoil shaped skin in contact with the core. The golf club may further include a golf club head having a golf club head body including at least a front face, a rear, a toe, and a heel. The golf club head body may further include a first plurality of apertures formed in the front face of the golf club head body. In at least some examples, the apertures may extend through an interior of the golf club head body to the rear of the golf club head body. In some arrangements, the apertures may be formed at a periphery of the front face of the golf club head body. In some examples, the golf club may further include a second plurality of apertures formed in the rear of the golf club head body, the second plurality of apertures may be substantially aligned with the first plurality of apertures formed on the front face of the golf club head. In at least some arrangements, a size of the apertures of the second plurality of apertures may be different from a size of the apertures of the first plurality of apertures. Additionally or alternatively, a shape of the apertures of the second plurality of apertures may be different from a shape of the apertures of the first plurality of apertures.

In at least some examples, a portion of the first plurality of apertures extending through the interior of the golf club head may have a constant size from the front face of the golf club head body to the rear portion of the golf club head body. In other examples, the portion of the first plurality of apertures extending through the interior of the golf club head may taper from the front face of the golf club head body to the rear portion of the golf club head body. In still other arrangements, the portion of the first plurality of apertures extending through the interior of the golf club head may taper as the portion extends from the front face to the rear portion to a narrowest point within the interior of the golf club head and may widen as the portion extends from the narrowest point to the rear portion of the golf club head body.

In at least some examples, the front face may include a central region substantially void of apertures. In some arrangements, the central region may be a ball striking surface or a portion thereof.

Still other aspects of the invention relate to golf club heads. The golf club head may include a golf club head body having a front face, a rear, a toe, a heel, a top or crown and a bottom or sole defining an interior of the golf club head body. The golf club head may further include a first plurality of apertures formed in the front face of the golf club head body. The golf club head may further include a second plurality of apertures formed in the rear portion of the golf club head body. In at least some examples, the second plurality of apertures may be substantially aligned with the first plurality of apertures. In some arrangements, the first plurality of apertures may include a portion that extends through the interior of the golf club head body to join with the second plurality of apertures formed in the rear of the golf club head body, the portion of the first plurality of apertures extending through the interior of the golf club head body having a non-constant cross section Given the general description of various example aspects of the invention provided above, more detailed descriptions of various specific examples of golf clubs, golf club shaft and golf club head structures according to the invention are provided below.

III. Detailed Description of Example Golf Club, Golf Club Shaft and Golf Club Heads According to the Invention The following discussion and accompanying figures describe various example golf clubs, golf club shafts and golf club heads in accordance with the present invention. When the same reference number appears in more than one drawing, that reference number is used consistently in this specification and the drawings to refer to the same or similar parts throughout.

Various golf club shafts and golf club head features in accordance with aspects described herein may be used with various types of golf clubs. For instance, the golf club shafts and golf club head features described herein may be used with wood-type golf clubs and golf club heads, e.g., clubs and club heads typically used for drivers and fairway woods, as well as for "wood-type" utility or hybrid clubs, or the like. Such club head structures may have little or no actual "wood" material and still may be referred to conventionally in the art as "woods" (e.g., "metal woods," "fairway woods," etc.). The golf club shafts and club head features may also be used with iron-type golf clubs and golf club head structures.

Golf club heads may generally includes a plurality of different regions, segments, portions, ends, etc. In an example embodiment, a golf club head may generally include a front face, a rear, a toe, a heel, a crown and a sole that may, generally, define an interior of the golf club head. The golf club heads may include a multiple piece construction and structure, e.g., including one or more of a sole, a front face (optionally including a ball striking surface that may be integrally formed therein or attached thereto), a top or crown, a bottom or sole, a rear, etc. Of course, if desired, various portions of the club head structure may be integrally formed with one another, as a unitary, one piece construction, without departing from the invention (e.g., the front face and/or rear may be integrally formed with the sole and/or crown, etc.). Optionally, if desired, the various portions of the club head structure (such as the sole, the crown, the face member, the rear, etc.) individually may be formed from multiple pieces of material without departing from this invention (e.g., a multi-piece crown, a multi-piece sole, etc.). Also, as other alternatives, if desired, the entire club head may be made as a single, one piece, unitary construction, or a front face may be attached to a one piece club head aft body (optionally, a hollow body, etc.). More specific examples and features of golf club heads and golf club structures according to this invention will be described in detail below in conjunction with the example golf club structures illustrated in FIGS. 1 through 10.

Figure 1B:
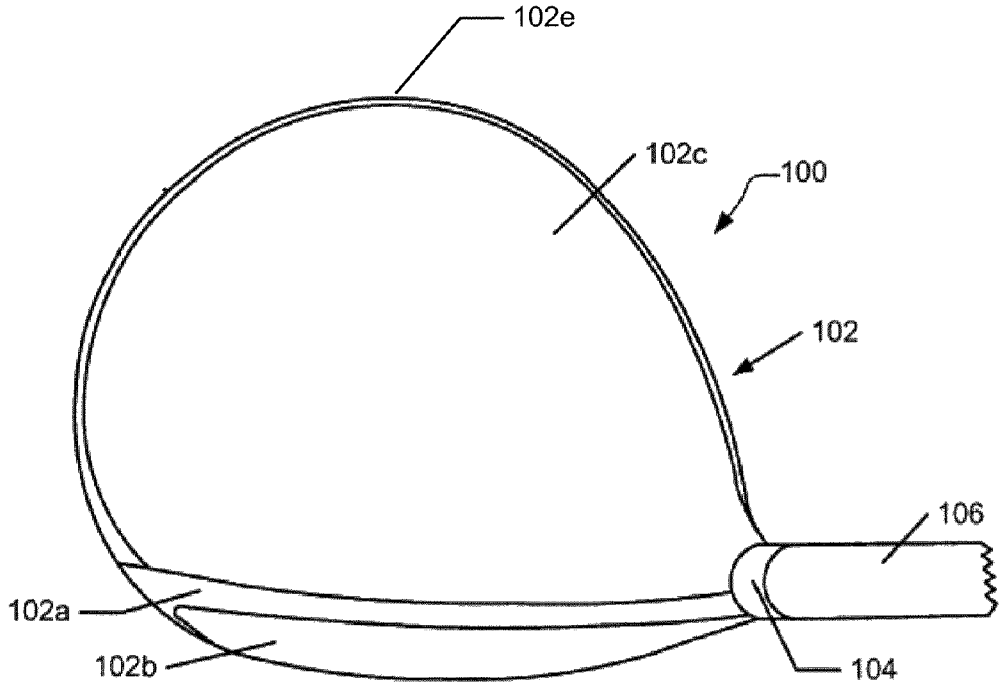

FIGS. 1A and 1B generally illustrate an example wood-type golf club 100 and/or golf club head 102 in accordance with this invention. As mentioned above, aspects of the golf club shaft and golf club head features described herein may be used with various other types of golf clubs and golf club head structures, including hybrid type clubs, iron-type clubs, and the like. Although the general description of golf club structures found in FIGS. 1A and 1B is generally directed to wood-type golf club heads, nothing in the disclosure should be viewed as limiting use of golf club shafts and golf club head features as described herein to use with only wood-type golf clubs. Instead, the golf club shafts and golf club head features described herein may be used with various types of golf clubs without departing from the invention.

In addition to the golf club head 102, the overall golf club structure 100 of this example includes a hosel 104, a shaft 106 received in and/or inserted into and/or through the hosel 104, and a grip or handle 108 attached to the shaft 106. Optionally, if desired, the external hosel 104 may be eliminated and the shaft 106 may be directly inserted into and/or otherwise attached to the head 102 (e.g., through an opening provided in the top of the club head 102, through an internal hosel member (e.g., provided within an interior chamber defined by the club head 102), etc.).

The shaft 106 may be received in, engaged with, and/or attached to the club head 102 in any suitable or desired manner, including in conventional manners known and used in the art, without departing from the invention. As more specific examples, the shaft 106 may be engaged with the club head 102 via a hosel 104 and/or directly to the club head structure 102, e.g., via adhesives, cements, welding, soldering, mechanical connectors (such as threads, retaining elements, or the like), etc.; through a shaft-receiving sleeve or element extending into the club head body 102, etc. If desired, the shaft 106 may be connected to the head 102 in a releasable manner using mechanical connectors to allow easy interchange of one shaft for another on the head.

In some examples, the club head/shaft connection may include an "off-axis" or angled bore hole or interior chamber in which the shaft 106 (optionally a straight shaft) is received. More specifically, an outer cylindrical surface of the connection member may extend in a first axial direction, and an interior cylindrical surface of the bore hole may extend in a second axial direction that differs from the first axial direction. In this manner, while the shaft connection member exterior maintains a constant axial direction corresponding to that of the interior of the club head hosel and its opening, the shaft 106 extends away from the club head 102 at a different and, in some examples, adjustable angle with respect to the club head 102 and its ball striking face. Additional aspects of this off-axis arrangement are described in U.S. application Ser. No. 11/846,370 filed Aug. 28, 2007 and entitled "Releasable and Interchangeable Connections for Golf Club Heads and Shafts," which is incorporated herein by reference in its entirety.

The shaft 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle 108 may be attached to, engaged with, and/or extend from the shaft 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle 108 may be integrally formed as a unitary, one-piece construction with the shaft 106. Additionally, any desired grip or handle 108 materials may be used without departing from this invention, including, for example: rubber materials, leather materials, rubber or other materials including cord or other fabric material embedded therein, polymeric materials, and the like.

The club head 102 itself also may be any of various types of golf club heads and may be constructed in any suitable or desired manner and/or from any suitable or desired materials without departing from this invention, including from conventional materials and/or in conventional manners known and used in the art. For example, in the exemplary structure 102 shown in FIGS. 1A and 1B, the club head 102 includes a front face 102*a* that defines a ball striking surface 102*b* (the ball striking surface 102*b* may optionally comprise a plate that may be integrally formed with the front face 102*a* or attached to the club 100 such that the ball striking surface plate and a frame member together constitute the overall face member 102*a*). The club head 102 of this illustrated example further includes a crown 102*c*, a sole 102*d*, a rear 102*e*, a toe 102*f* and a heel 102*g*. In some examples, the front face 102*a* (and optionally the ball striking surface 102*b*), crown 102*c*, sole 102*d*, rear 102*e*, toe 102*f* and heel 102*g* may define an interior of a golf club head. A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown 102*c*, sole 102*d*, rear 102*e*, etc.) may be made from any desired materials and combinations of different materials, including materials that are conventionally known and used in the art, such as metal materials, including lightweight metal materials. More specific examples of suitable lightweight metal materials include steel, titanium and titanium alloys, aluminum and aluminum alloys, magnesium and magnesium alloys, etc.

As additional examples or alternatives, in order to reduce the weight of the club head 102, if desired, one or more portions of the club head structure 102 advantageously may be made from a composite material, such as from carbon fiber composite materials that are conventionally known and used in the art. Other suitable composite or other non-metal materials that may be used for one or more portions of the club head structure 102 include, for example: fiberglass composite materials, basalt fiber composite materials, polymer materials, etc. The composite or other non-metal material(s) may be incorporated as part of the club head structure 102 in any desired manner, including in conventional manners that are known and used in the art.

The various individual parts that make up a club head structure 102, if made from multiple pieces, may be engaged with one another and/or held together in any suitable or desired manner, including in conventional manners known and used in the art. For example, the various parts of the club head structure 102, such as the front face 102*a*, the ball striking surface 102*b*, the crown 102*c*, the sole 102*d*, the rear 102*e*, etc. may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 (e.g., the edges where members 102*a*, 102*b*, 102*c*, 102*d*, 102*e*, 102*f*, 102*g*, etc. contact and join to one another) may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention.

Figure 2:
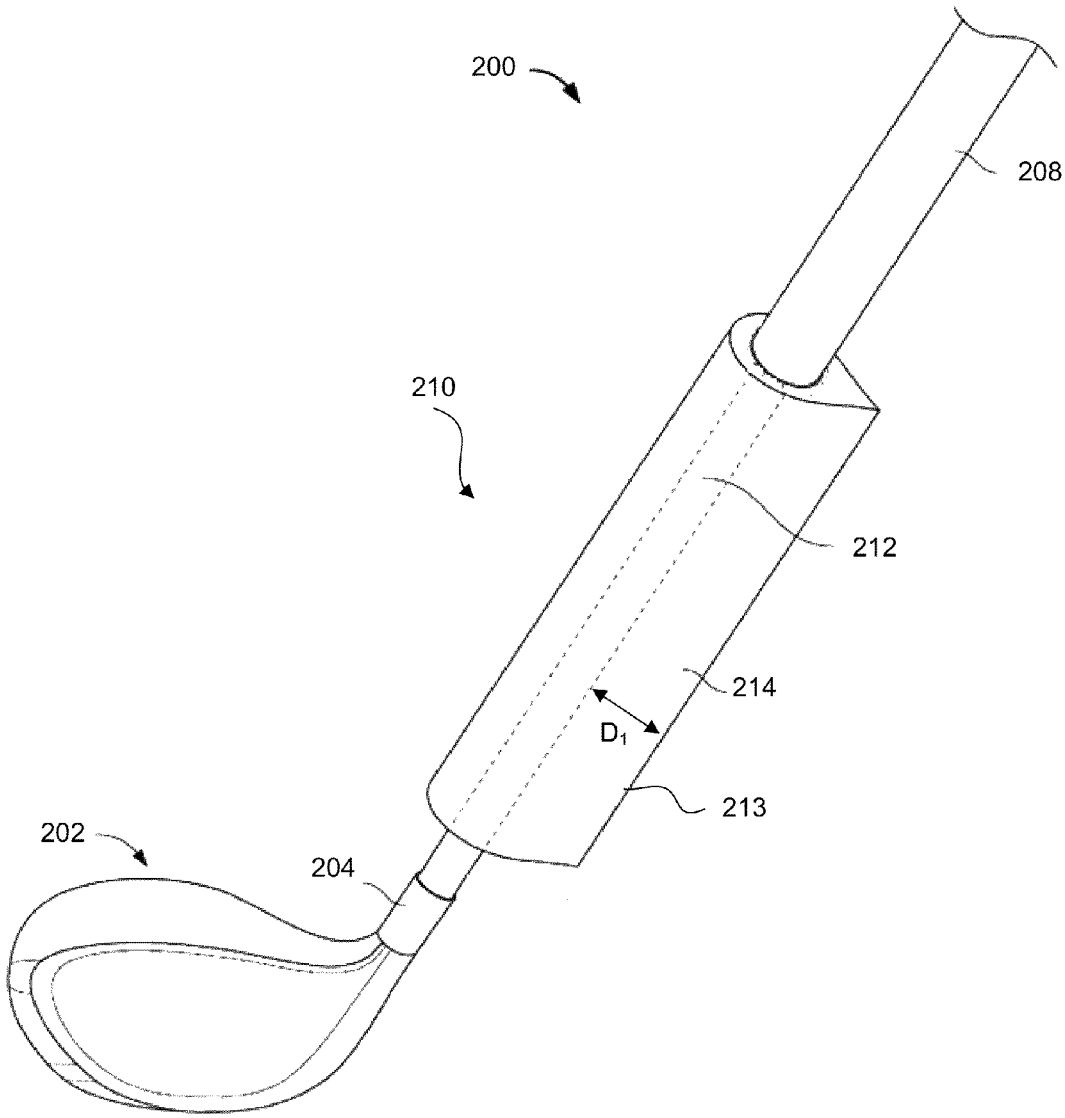
FIG. 2 illustrates one example golf club having a wind resistant shaft according to at least some examples of this invention.

FIG. 2 illustrates one example golf club 200 having a shaft 210 shaped to reduce wind resistance during a golf swing. The golf club 200 includes a club head 202 connected to the shaft 210 at a hosel 204. The golf club head 202 may be any known golf club head type including wood-type golf club heads, iron type golf club heads, hybrid-type golf club heads, utility-type golf club heads, and the like. The golf club 200 further includes a shaft 210 shaped to reduce wind resistance during a golf swing. For instance, the shaft 210 may include a core 212 that may be similar to a standard shaft core. For instance, the core 212 may have a round or substantially circular cross section and may be formed of various known materials that provide flexibility as desired. In addition, the shaft 210 may include an airfoil shaped skin 214 that is in contact with the core 212. In some arrangements, the airfoil shaped skin 214 may be in contact with the core 212 but not permanently connected to the core 212. The airfoil shaped skin 214 may aid in reducing wind resistance during a golf swing, as will be discussed more fully below. The golf club 200 may further include a grip member 208, as will be discussed more fully below. In some arrangements, the airfoil shaped shaft 210 may taper as it nears the hosel and/or may transition to a more traditional cross-section.

The skin 214 may be formed of conventional shaft materials, such as steel, aluminum, composite, and the like. Further, the skin 214 may be in contact with the core 212 so as to allow movement of the skin with or relative to the core 212. For instance, as the golf club impacts a golf ball, the skin 214 and core 212 may bend or flex. The skin 214 may permit this movement in order to provide improved performance. In some examples, stiffer materials, such as steel, etc., may be used for the skin 214 in order to minimize this bending of the shaft 210. In other examples, more flexible materials may be used for the skin 214 in order to maximize this bending and provide a more forgiving golf shot. In still other examples, although the skin 214 may bend or flex relative to the core 212, the skin 214 and core 212 arrangement may, in some arrangements, prevent rotation of the skin 214 relative to the core 212.

In some examples, the skin 214 and core 212 may be formed of the same or substantially similar materials. In other examples, the skin 214 and core 212 of the shaft 210 may be formed of different materials to adjust the performance characteristics of the golf club.

As shown in FIG. 2, the skin 214 may be arranged over or around the core 212 such that the tail end 213 of the airfoil shaped skin may extend beyond the core 212 of the shaft 210. In some examples, the tail end of the skin 214 may extend behind the core 212 of the shaft 210 during a golf swing to promote air flow over the shaft 210 during the swing. In some examples, the skin 214 may extend behind the core 212 a length (shown as $D_1$ in FIG. 2) of 1.0 to 2.5 cm. For instance, in some arrangements, the skin 214 may extend behind the core 212 approximately 1.5 cm.

Figure 4:
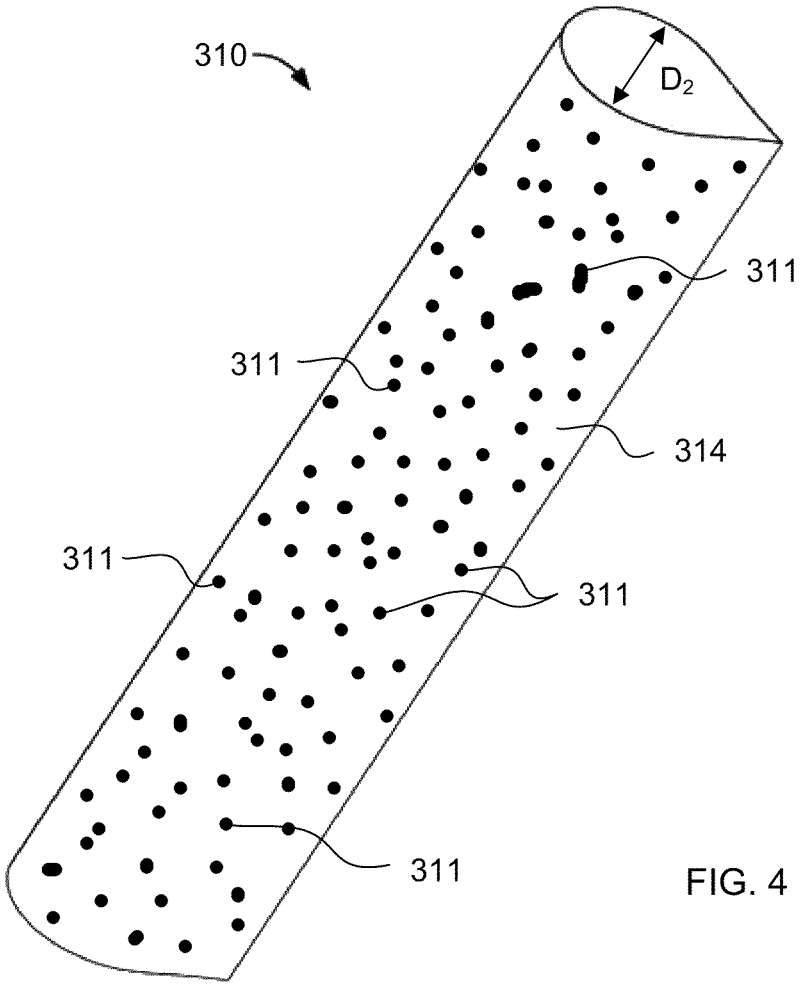
FIG. 4 illustrates one example golf club shaft having a textured, airfoil shaped skin according to at least some aspects of this invention.

In some examples, such as the golf club shown in FIG. 2, the widest portion of the airfoil shaped skin 214 may align with a diameter of the core 212. For instance, the widest portion of the skin 214 may be a midsection of the skin 214. This midsection point may align with the widest portion of the core 212 (e.g., along the diameter of the core 212). In some examples, this widest portion (shown as $D_2$ in FIG. 4) of the airfoil shaped skin 214 may be between 2.5 and 4.5 cm. In some arrangements, the widest portion of the skin 214 may be approximately 2.5 cm. The position of $D_2$ shown in FIG. 4 is merely one example location of the widest portion of the airfoil shaped skin 214 and nothing in the specification or figures should be viewed as limiting the widest portion to only that location. Rather the widest portion may vary based on the desired geometry of the airfoil shaped skin 214.

Figure 3:
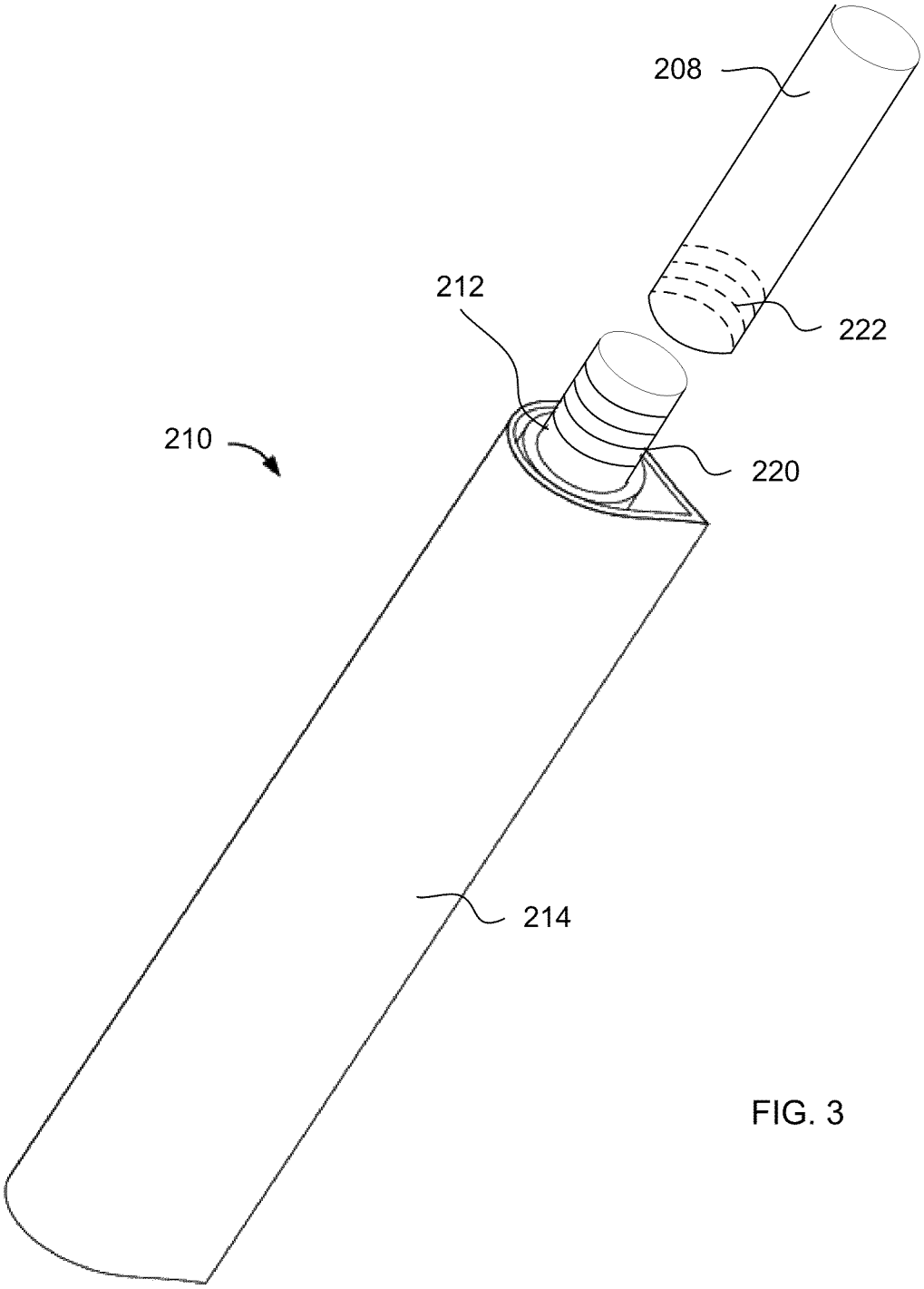
FIG. 3 illustrates one example golf club shaft and grip member according to at least some aspects of this invention.

FIG. 3 is an enhanced view of the shaft 210 and grip 208 of the golf club of FIG. 2 that may be used in accordance with aspects of the invention. In some arrangements, the grip 208 may be removably connected to the shaft 210. For instance, a portion of the shaft 210 (e.g., the core 212 of the shaft 210) may protrude upward, above the skin 214, in some examples and may include a fastener 220, 222, such as a mechanical fastener, adhesive, etc. As shown in FIG. 3, the core 212 may include a male threaded end 220 configured to mate with a corresponding female threaded end 222 of the grip 208.

Although the core 212 is shown as having a male portion of the threaded end 220 and the grip 208 having a corresponding female portion 222, the core 212 may, in some examples, include a recess having a female portion while the grip 208 includes a male fastening portion configured to be received in the female portion formed in the core 212.

In some examples, the skin 214 may be removable from the core 212 to permit the skin 214 to be interchanged with other skins having various size, shape, performance, etc. characteristics. For instance, the grip 208 may be removed and the skin 214 may be removed from the core 212, such as by sliding the skin 214 upward, away from the head of the golf club. Another skin may then be slid downward, toward the golf club head, onto the core 212 to provide wind resistance during a golf swing. In some examples, skins of varying lengths (e.g., skins that may extend to the hosel region, skins that may extend approximately half way down the shaft, etc.) may be used. In other examples, one or more skins may be interchanged with a skin having a longer tail end (e.g., a tail extending a greater distance $D_1$ behind the core 212 of the shaft 210) to provide additional wind resistance. In still other examples, skins having various texture arrangements, as will be described more fully below, may be interchanged to alter the air flow over the skin 214.

Figure 10:
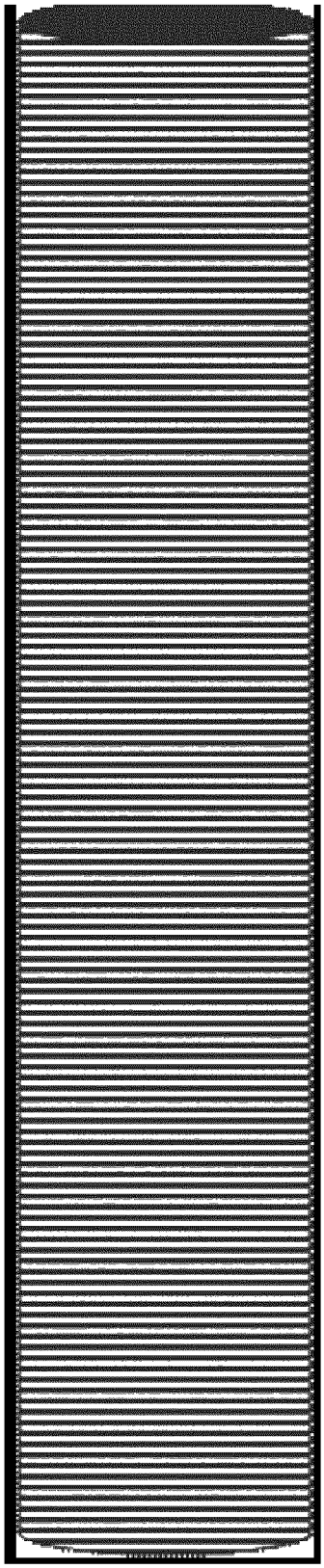
FIG. 10 illustrates one example texture that may be provided on a shaft in accordance with at least some examples of the invention.

In some examples, the skin 214 of the shaft 210 may include a textured exterior surface to provide additional wind resistance. The textured surface may create turbulence as air passes over the shaft during a golf swing and may further aid in reducing drag associated with the shaft during the swing. FIG. 4 illustrates one example golf club shaft 310 having a skin 314 including texture 311. In some examples, the texture 311 may be formed using a spray on metal texture. Additionally or alternatively, the texture 311 may be created using various processing techniques, such as shot peening, sand blasting, and the like. In still other examples, the texture 311 may be embossed or, in some examples, debossed, on the skin 314. For instance, fine, low profile, non-cross grid horizontal lines may be embossed on the skin to provide texture 311. FIG. 10 illustrates one example of embossed texture that may be used in accordance with at least some aspects of the invention. In still other examples, a combination of these types of texture, texturing methods, etc. may be used on the skin 314. The combination of textures may be found in distinct texture regions on the skin 314 or may be combined (e.g., overlay) throughout the entire skin 314 or a portion of the skin 314. The texture 311 may be distributed on an entire exterior surface of the skin 314 or may, in some examples, be on a portion of the skin 314 less than the entire exterior surface of the skin 314. In some arrangements, skins of varying textures may be provided and may be interchangeable, as discussed above, to provide different performance characteristics in different playing conditions. In some examples, the depth and/or height of the texture may be low so as to not impair smooth air flow during a golf swing. In still other examples, the height, depth, type or style of texture, etc. may vary along the length of the skin.

Figure 5:
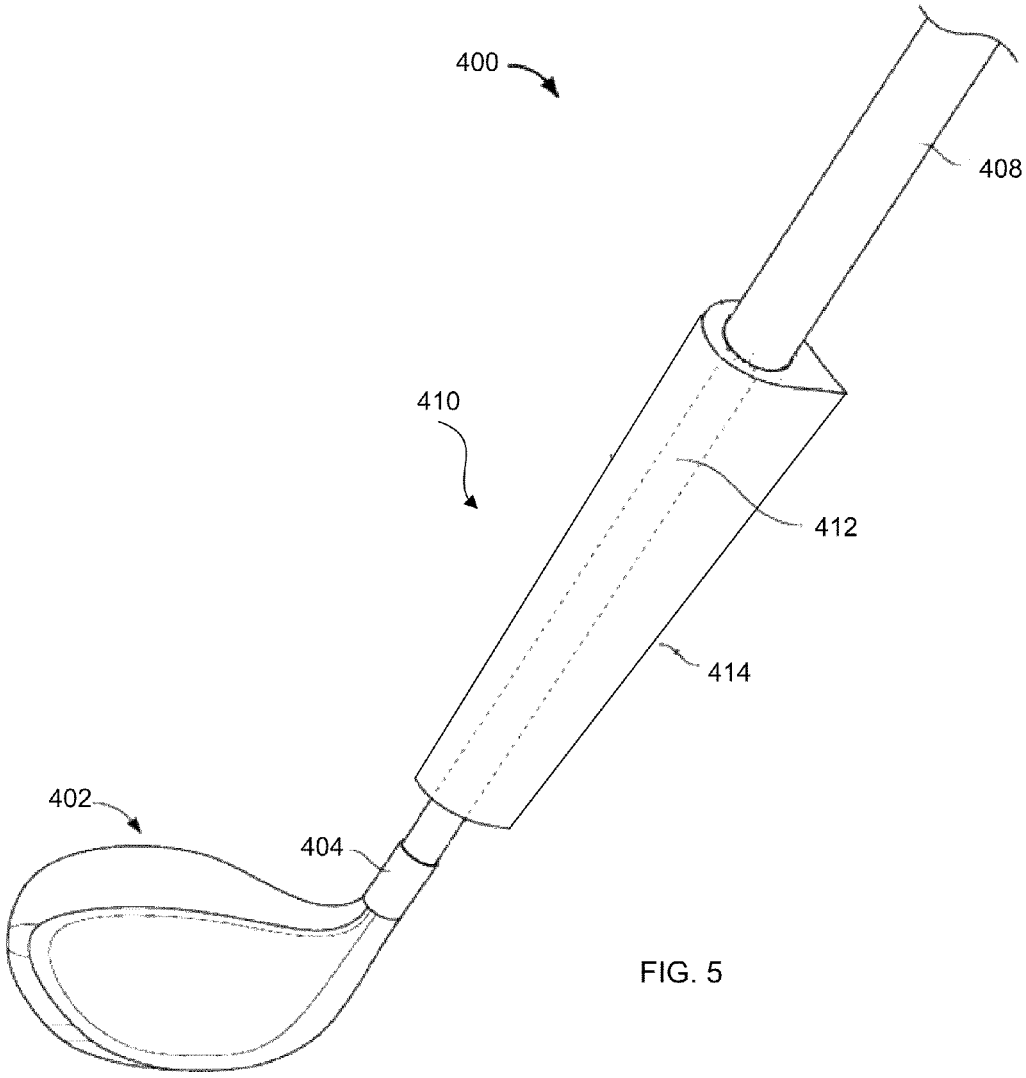
FIG. 5 illustrates another example golf club having a wind resistant shaft according to at least some aspects of this invention.

The golf club and golf club shaft arrangements shown in FIGS. 2-4 are generally illustrated as having a constant cross section along the length of the shaft. For instance, the shaft (including the skin and/or core) may have a substantially similar size, shape, configuration, etc. at a first end of the shaft as at a second end of the shaft. In other examples, the shaft and/or the core may be tapered (e.g., the skin or core at one portion of the shaft may have a different size/diameter than the skin and/or core of the shaft at another portion of the shaft). FIG. 5 illustrates one example of a golf club 400 having a tapered shaft 410. Similar to the arrangement of FIG. 2, the golf club 400 includes a golf club head 402 connected to one end of the shaft 410 at a hosel 404. The golf club 400 may further include a grip 408. In the example shown in FIG. 5, the core 412 has a constant cross section but the skin 414 tapers as the shaft 410 extends from the grip to the golf club head 402. This tapering of the shaft 410 may further aid in reducing drag associated with the shaft 410 by providing less material to cut through the air during a golf swing. In other examples, both the skin 414 and core 412 may taper near one end of the shaft 410. In still other examples, the skin 414 and/or core 412 may have a portion having a constant cross section and another portion having a tapered cross section (e.g., the taper may begin at a point between the grip 418 and the golf club head 402, such as a midpoint, etc.).

Figure 6A:
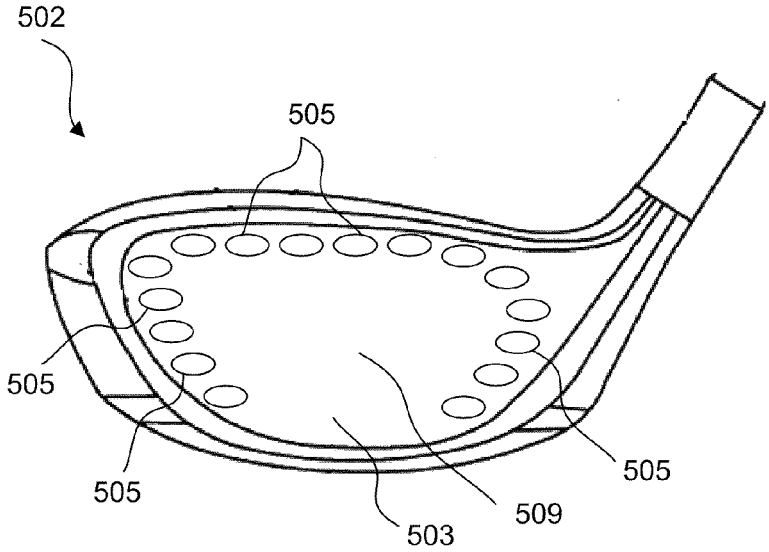
FIGS. 6A and 6B illustrate an example golf club head having wind resistant characteristics according to at least some aspects of this invention.

FIGS. 6A-8B illustrate yet another drag reducing aspect of the invention. FIG. 6A is a front view of a golf club head 502 having a plurality of holes or apertures 505 formed in the front face 503 of the golf club head 502 and extending through the golf club head 502 from the front face 503 to the rear 507 of the club head 502, as shown in the top view of the golf club head 502 in FIG. 6B. In the example shown in FIG. 6A, the apertures 505 are substantially oval in shape, however, various other shapes may be used without departing from the invention, such as round, square, rectangular, triangular, pentagonal, hexagonal, octagonal, and the like.

In one example, the apertures 505 may be formed at least around a substantial portion of a periphery of the front face 503 of the golf club head 502, as shown in FIG. 6A. In some arrangements, the front face 503 may be void of apertures 505 in a central, ball striking region 509. In some examples, the apertures 505 may be arranged on the entire front face 503 of the golf club head 502. In other examples, the apertures 505 may be arranged on a portion of the front face 503 less than the entire front face 503. For instance, in some arrangements, the apertures 505 may comprise less than 75% of the front face 503 of the golf club head 502. In other examples, the apertures 505 may be arranged on less than 50% of the front face 503 of the golf club head 502. In still other examples, the apertures 505 may be arranged on 10% to 40% of the front face 503 of the golf club head 502. The apertures 505 may permit air to flow through the golf club head 502 during a golf swing. This movement of air through the club head 502 (rather than around the club head 502) may reduce drag associated with the golf club head 502, thereby aiding in increasing swing speed, increasing a distance the ball is hit, etc. In some examples, the apertures may be between 0.5 and 3.0 cm in diameter. In some particular examples, the apertures may be between 1.0 and 1.5 cm in diameter.

Figure 6B:
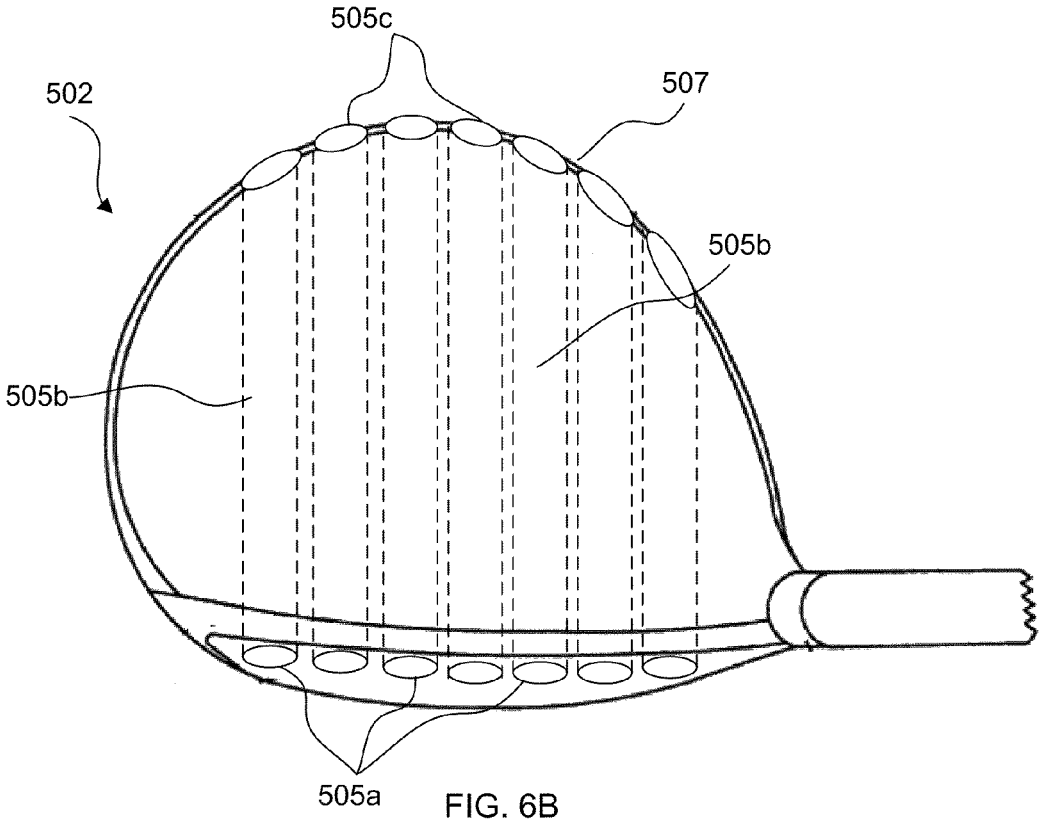

As shown in FIG. 6B, the apertures 505*a* formed in the front face 503 of the golf club head 502 extend through the club head 502 to a rear 507 of the golf club head 502 and substantially align with apertures 505*c* formed in the rear of the golf club head. In some examples, such as in FIGS. 6A and 6B, the apertures may have a constant size, shape, configuration, etc. from the front face apertures 505*a*, through the club head 502 (apertures 505*b*) and at the rear 507 (apertures 505*c*). In other examples, the apertures 505*c* at the rear 507 of the club head 502 may have a different shape, size, configuration, etc. than the apertures 505*a* or the holes 505*b* extending through the club head 502. For instance, the apertures 505*c* may be larger or smaller than the apertures 505*a*. Additionally or alternatively, the apertures 505*c* may be a different shape than apertures 505*a*. For instance, apertures 505*a* may be substantially oval while apertures 505*c* may be substantially circular.

Figure 7A:
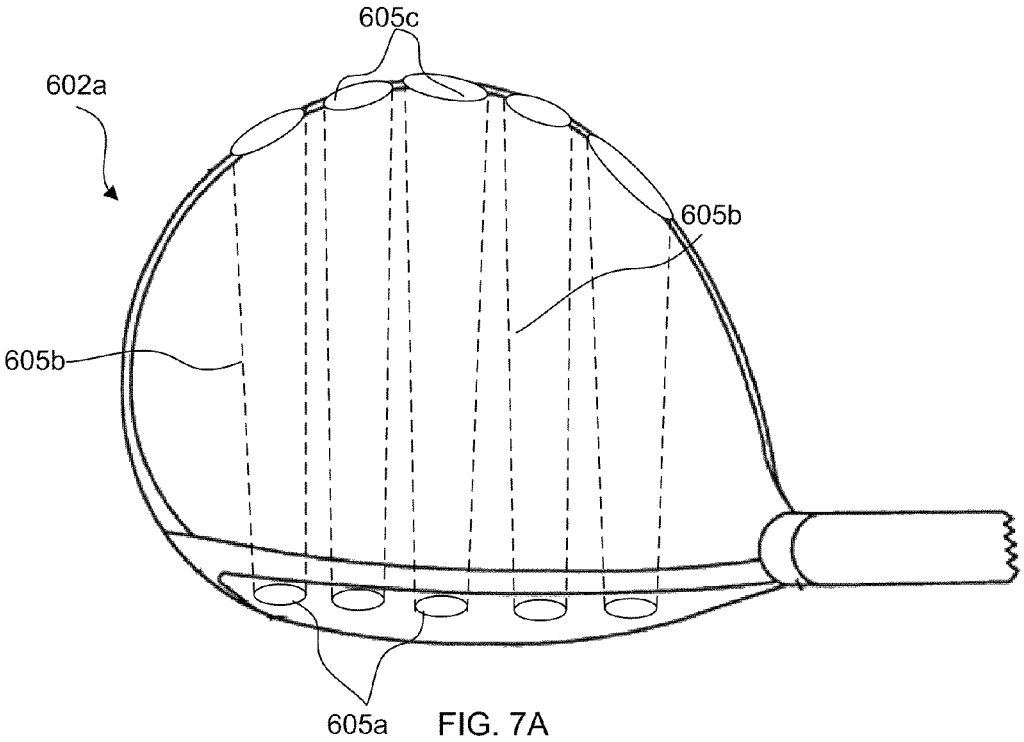
FIGS. 7A and 7B illustrate various additional golf club head aperture arrangements according to at least some aspects of this invention.
Figure 7B:
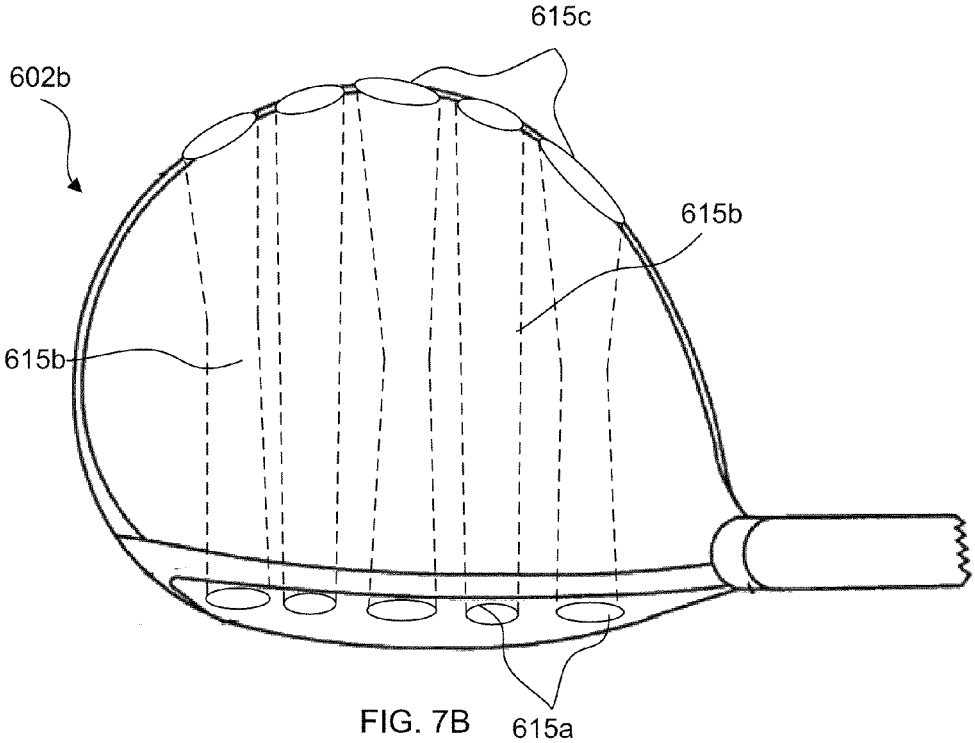

FIGS. 7A and 7B illustrate various additional aperture arrangements that may be used in accordance with at least some aspects of this invention. Golf club head 602*a* includes apertures 605. In some examples, the apertures 605 may have non-constant cross section, such as a varying size, shape, etc. along the length of the aperture 605. In the arrangement shown in FIG. 7A, the apertures 605*b* may taper. For instance, the apertures 605*b* may be narrower near a front or rear of the club head 602*a*. As shown, the apertures 605*b* get larger as they extend from front apertures 605*a* to rear apertures 605*c*. This arrangement may aid in moving more air through the apertures, thereby reducing drag, increasing swing speed, etc.

FIG. 7B illustrates yet another aperture arrangement. Golf club head 602*b* includes apertures 615*b* having a nozzle-type shape. That is, the portion of apertures 615*b* extending between the front aperture 615*a* and rear aperture 615*c* taper as they extend from front to rear (or vice versa) to a narrowest point between the front apertures 615*a* and rear apertures 615*c* and then widen again. This arrangement may further aid in moving air through the golf club head 602*b* and may reduce drag, increase swing speed, etc. In some examples, all apertures 615*b* may have the nozzle-type shape. In other examples, such as shown in FIG. 7B, the apertures 615*b* may have differing configurations. That is, some apertures 615*b* may have a nozzle-type shape, others may have a constant size, others may taper at an end, etc.

FIGS. 8A-8D illustrate various aperture arrangements that may be used in accordance with at least some aspects of this invention. Although several arrangements are illustrated including apertures of various sizes, shapes, etc., nothing in the specification and figures should be viewed as limiting the aperture arrangements to only those shown in FIGS. 8A-8D. These are merely examples of possible arrangements.

Figure 8A:
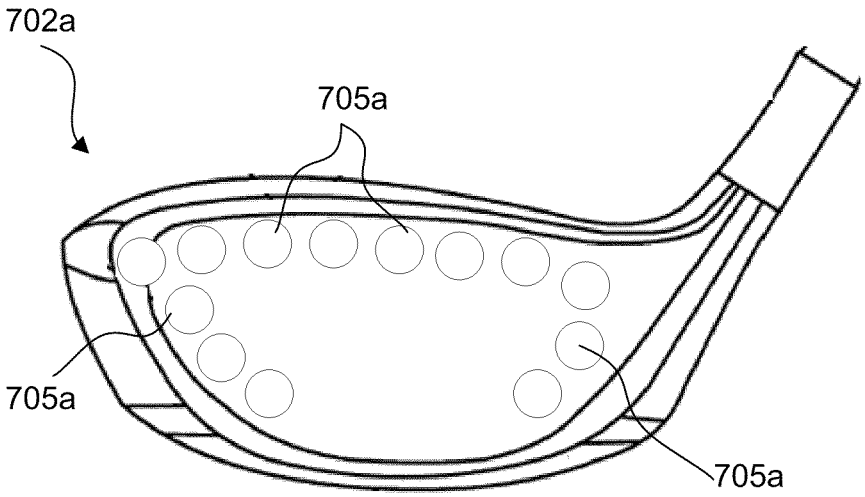
FIGS. 8A-8D illustrate various additional golf club head aperture arrangements according to at least some aspects of this invention.
Figure 8B:
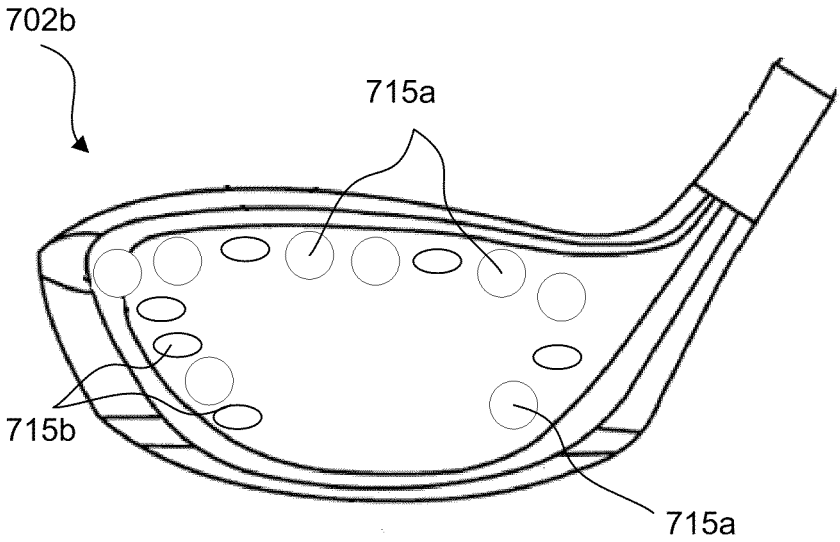
Figure 8C:
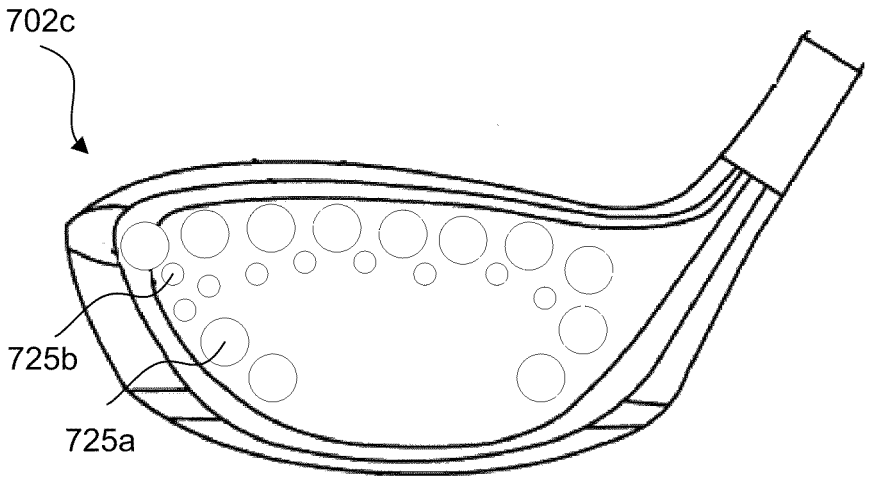

FIG. 8A illustrates a golf club head 702*a* having apertures 705*a* with a substantially circular cross section. The apertures 705*a* may have the same or substantially similar sizes, as shown in FIG. 8A. FIG. 8B illustrates a golf club head 702 having apertures 715*a*, 715*b* with different cross sections. For instance, a portion of the apertures 715 may have a substantially circular cross section, such as apertures 715*a*, while another portion of the apertures 715 may have a substantially oval cross section, such as apertures 715*b*. Although the apertures 715*a*, 715*b* have a generally consistent size for each shaped aperture, the size of the apertures may vary, as shown in FIG. 8C. The golf club head 702*c* of FIG. 8C includes apertures 725*a*, 725*b* having varying sizes. The apertures 725 may be arranged in a repeating or non-repeating pattern, as desired.

Figure 8D:
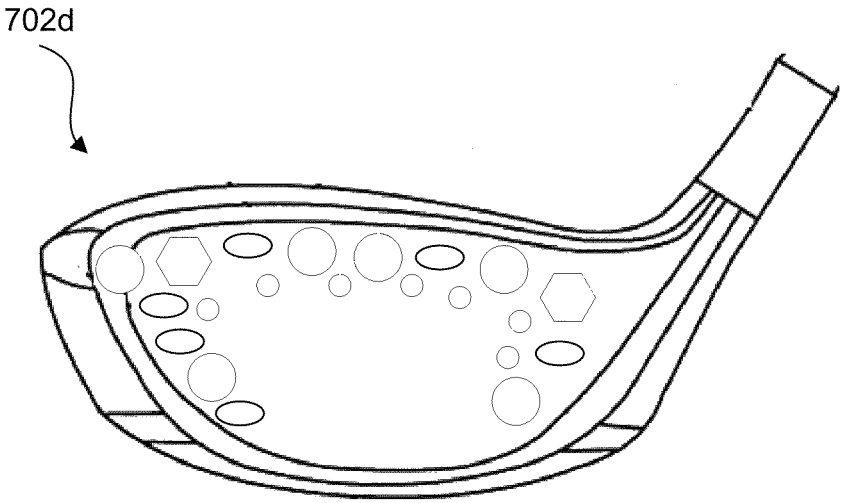

FIG. 8D illustrates a golf club head 702*d* having yet another aperture arrangement. The apertures include apertures of varying sizes, shapes, etc. The apertures may be arranged in a repeating or non repeating patter.

Similar to the arrangements discussed above, the aperture arrangements shown in FIGS. 8A-8D may include apertures of different sizes, shapes, etc. positioned on a rear of the golf club head. Additionally or alternatively, the portion of the apertures extending through the golf club head may have varying sizes, shapes, etc.

Figure 9:
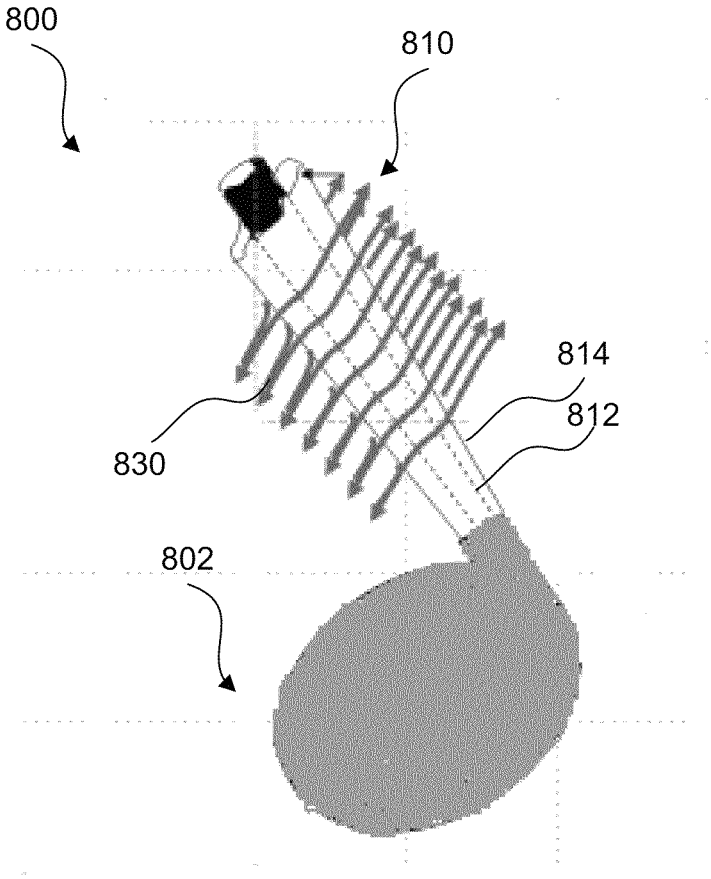
FIG. 9 illustrates air flow over a golf club having at least some of the wind resistant features according to at least some aspects of this invention.

FIG. 9 illustrates air flow over a golf club 800 having at least some wind resistant features, as discussed herein. The golf club 800 includes a shaft 810 having an airfoil shaped skin 814. As the golf club is swung, air passes over the shaft 810 (as indicated by arrows 830) and the aerodynamically shaped skin 814 aids in reducing drag associated with the shaft 810 as air flows over it, both during a backswing and a downswing. In some arrangements, the airfoil shaped skin 814 may taper on either or both sides of the core 812. This may aid in further reducing drag over the shaft 810 during both backswing and downswing.

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A through 10 may be used individually and/or in any combination or subcombination without departing from this invention.

What is claimed is:

1. A golf club, comprising:

a golf club head;

a shaft having a first end connected to the golf club head and further including a core formed of a first material and an airfoil shaped skin having a teardrop shaped profile and formed of a second material, the airfoil shaped skin extending completely around the core and in contact with the core, the airfoil shaped skin being removable from and freely rotatable relative to the core during a golf swing and including a textured exterior surface; and a grip removably connected to a second end of the shaft and configured to allow removal of the skin from the core, the grip including a fastener configured to mate with a corresponding fastener arranged on the core of the shaft.

2. The golf club of claim 1, wherein the first material and the second material are the same material.

3. The golf club of claim 1, wherein the first material and the second material are different materials.

4. The golf club of claim 1, wherein each of the fastener of the grip and the core of the shaft is a threaded fastener.

5. The golf club of claim 1, wherein the textured exterior surface of the airfoil shaped skin is formed using at least one of spray on metal texturing, shot peening and sand blasting.

6. The golf club of claim 1, wherein the airfoil shaped skin is not connected to the core.

7. The golf club of claim 1, wherein the grip is formed of a third material different from the first and second materials.

8. A golf club, comprising:

a golf club head;

a shaft having a first end connected to the golf club head and further including a core and airfoil shaped skin, the airfoil shaped skin having a teardrop shaped profile, extending completely around the core, being freely rotatable relative to and in contact with the core during a golf swing, and being removable from the shaft; and a grip removably connected to a second end of the shaft, the grip including a fastener configured to mate with a corresponding fastener arranged on the core of the shaft.

9. The golf club of claim 8, wherein the golf club head is one of a wood-type golf club head, iron-type golf club head and utility-type golf club head.

10. The golf club of claim 8, wherein the skin is in contact with the core but not connected to the core.

11. The golf club of claim 8, wherein each of the fastener of the grip member and the core of the shaft is a threaded fastener.

12. The golf club of claim 8, wherein the skin and the core are formed of the same material.

13. The golf club of claim 8, wherein the skin and the core are formed of different materials.

14. A golf club, comprising:

a golf club head;

a shaft having a first end connected to the golf club head at a hosel, the shaft including:

a core having a substantially circular cross section; and a skin arranged to extend completely around the core and having an airfoil shaped geometry and a teardrop shaped profile, the skin being in contact with and freely rotatable relative to the core during a golf swing and configured to flex with the core of the shaft.

15. The golf club of claim 14, wherein a widest portion of the skin is aligned with a diameter of the core.

16. The golf club of claim 15, further including a texture formed on an exterior surface of the skin.

17. The golf club of claim 16, wherein the textured is formed on substantially the entire exterior surface of the skin.

18. The golf club of claim 16, wherein the texture is formed on a portion of the exterior surface of the skin that is less than the entire exterior surface of the skin.

19. The golf club of claim 14, wherein the skin and the core are formed of the same materials.

20. The golf club of claim 14, wherein the skin and the core are formed of different materials.

21. A golf club, comprising:

a shaft having a core and an airfoil shaped skin in contact with the core, the airfoil shaped skin having a teardrop shaped profile, extending completely around the core, and being freely rotatable relative to the core during a golf swing;

a golf club head having a golf club head body including at least a front face including a ball striking surface, a rear, a toe, and a heel, the golf club head body including a first plurality of apertures formed in the front face of the golf club head body and extending through an interior of the golf club head body to the rear portion of the golf club head body, the apertures being formed at a periphery of the front face of the golf club head body.

22. The golf club of claim 21, further including a second plurality of apertures formed in the rear of the golf club head body, the second plurality of apertures being substantially aligned with the first plurality of apertures formed on the front face of the golf club head.

23. The golf club of claim 22, wherein a size of the apertures of the second plurality of apertures is different from a size of the apertures of the first plurality of apertures.

24. The golf club of claim 22, wherein a shape of the apertures of the second plurality of apertures is different from a shape of the apertures of the first plurality of apertures.

25. The golf club of claim 22, wherein a portion of the first plurality of apertures extending through the interior of the golf club head has a constant size from the front face of the golf club head body to the rear portion of the golf club head body.

26. The golf club of claim 22, wherein the portion of the first plurality of apertures extending through the interior of the golf club head tapers from the front face of the golf club head body to the rear portion of the golf club head body.

27. The golf club of claim 22, wherein the portion of the first plurality of apertures extending through the interior of the golf club head taper as the portion extends from the front face to the rear portion to a narrowest point within the interior of the golf club head and widen as the portion extends from the narrowest point to the rear portion of the golf club head body.

28. The golf club of claim 21, wherein a central portion of the front face is void of apertures.

29. The golf club of claim 21, wherein at least a portion of the ball striking surface is void of apertures.

30. The golf club of claim 21, wherein the airfoil shaped skin of the shaft further includes a texture formed on an exterior surface of the skin.

* * * * *